US005398859A

United States Patent [19]

Lee

[11] Patent Number: 5,398,859

[45] Date of Patent: Mar. 21, 1995

[54] MECHANISM FOR DRIVING FASTENER SUPPLY GEAR FOR TAG ATTACHER

[76] Inventor: Duck H. Lee, 840-14 Bangbae-Dong, Kangnam-Ku, Seoul, Rep. of Korea

[21] Appl. No.: 147,296

[22] Filed: Nov. 5, 1993

[30] Foreign Application Priority Data

Jan. 5, 1992 [KR] Rep. of Korea ..... 21722

[51] Int. Cl.[6] ..... B65C 7/00; B65C 5/11

[52] U.S. Cl. ..... 227/67

[58] Field of Search ..... 227/67, 68, 70, 71

[56] References Cited

U.S. PATENT DOCUMENTS 3,640,451 3/1972 Weiland et al. .
3,888,402 6/1975 Bone ..... 227/67
3,924,788 12/1975 Furutu .
4,040,555 8/1977 Jenkins .
4,049,177 9/1977 Bussard .
4,125,215 11/1978 Jenkins ..... 227/67
4,416,407 11/1983 Bone ..... 227/67
4,448,194 5/1984 Digiovanni et al. .
4,482,088 11/1984 Hyun .
4,502,622 3/1985 Lee ..... 227/67
4,592,499 6/1986 Kato .
4,593,844 6/1986 Bone .
4,802,615 2/1989 Lee .
4,969,589 11/1990 Kim ..... 227/67
4,971,238 11/1990 Furutsu ..... 227/67
5,152,445 10/1992 Furutsu ..... 227/67

*Primary Examiner*—Scott A. Smith
*Attorney, Agent, or Firm*—Oblon, Spivak, McClelland, Maier, & Neustadt

[57] ABSTRACT

A tag has a supply gear 4 rotatably installed at a side of a fastener supply guide slot by forming a supporting shaft 3, an insertion hole 3' and a supporting plate 3". Further, an arcuate sliding recess 5 is formed at a side of the supporting plate 3" and along the circumference of the gear 4. A movable piece 6 which is elastically connected to a ratchet 8 is movably placed in the arcuate recess 5, and is connected to an actuation bar 7. The ratchet is made to reliably contact with the gear 4, and a stopper 11 is elastically installed on the upper portion of the gear 4, while an unlocking bar 11 which is provided with cam surfaces 14 and 14' on the opposite ends thereof is inserted into a slot 5'. The actuation bar 7 is actuated in synchronization with the tag attaching operations, so that the alternate arcuate movements of the movable piece 6 make the ratchet drive the gear in an accurate manner in supplying the fasteners.

9 Claims, 4 Drawing Sheets

MECHANISM FOR DRIVING FASTENER SUPPLY GEAR FOR TAG ATTACHER

BACKGROUND OF THE INVENTION

1. Field of the Invention

The present invention relates to a ratchet type mechanism for driving a fastener supply gear of a tag attacher.

2. Background of the Related Art

Conventionally there are many types of mechanisms for driving the fastener supplying gear of a tag attacher. Of them, U.S. Pat. No. 3,650,451 discloses a device for driving the fastener supplying gear by means of a ratchet. That is, on the leading end of a reciprocating bar there is provided a rake shaped ratchet for driving the gear while in contact with the lower portion of the gear. However, the contact between the ratchet and the gear is unstable and if the main body is subjected to an impact, the ratchet disengages from the gear. Consequently, the gear is not surely driven, with the result that the fastener cannot be supplied; the gear merely performs idle revolutions.

In Korean Utility Model Publication No. 82-212 the leading end of an actuation bar which moves back and forth has a rake shaped ratchet for driving the gear in a rectangular contact with the upper portion of the gear. The contact between the ratchet and the gear is here also unstable and the reliability of the up and down movements of the ratchet is deteriorated due to the need to convert the back and forth movements of the actuation bar to up and down movements of the ratchet. Therefore, the fastener supply fails under even a slight impact on the main body.

SUMMARY OF THE INVENTION

The present invention is intended to overcome the above described disadvantages of the conventional techniques.

It is a further object of the present invention to provide a mechanism for driving a fastener supplying gear for a tag attacher, in which the fasteners can be supplied in an accurate manner, the fasteners can be extracted upward, and the structure is simple enough for the mechanism to be narrow.

The above and other objects are achieved by the mechanism of the present invention, which includes a fastener supplying gear fitted to a side of a fastener guide slot formed on the main body of the tag attacher. At a side of the gear, a sliding recess is formed in an arcuate shape along the circumference of the gear. A movable piece with a flat spring and a ratchet installed thereon is movably secured in the sliding recess so that the straight lateral movements of an actuation bar are converted to up and down arcuate movements of the movable piece in synchronization with the fastener attaching motions. The ratchet is thus made to drive the fastener supplying gear in a stable manner so that the fasteners can be supplied in an accurate manner.

On the upper part of the main body, there is installed an unlocking bar for unlocking the stopper of the main body and the ratchet simultaneously. Thus, the gear can be easily unlocked during use to extract the fasteners upward. The structure is simple so that the mechanism can be assembled within a narrow space. The movable piece is securely installed within the sliding recess and therefore, even if the main body is subjected to an impact by striking or dropping, there is no possibility that the ratchet separates from the gear or otherwise deviates from its track. Therefore, the safety and convenience of the device is superior to the conventional devices.

BRIEF DESCRIPTION OF THE DRAWINGS

The above objects and other advantages of the present invention will become more apparent from the following description of the preferred embodiment of the present invention with reference to the attached drawings in which.

DESCRIPTION OF THE PREFERRED EMBODIMENT

Figure 1:
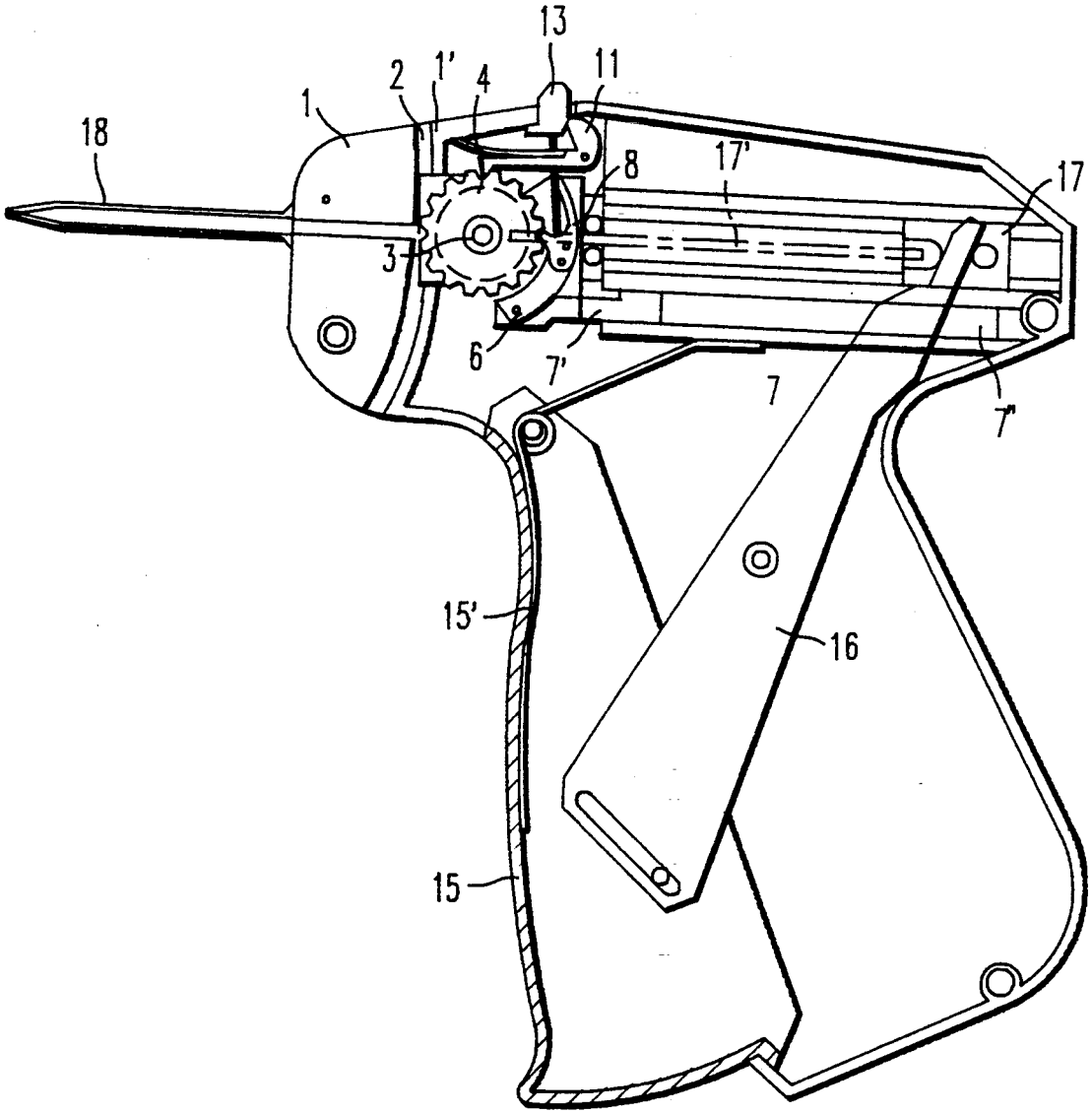
FIG. 1 is a side view of a device according to the present invention, with the cover of one side being removed.
Figure 2:
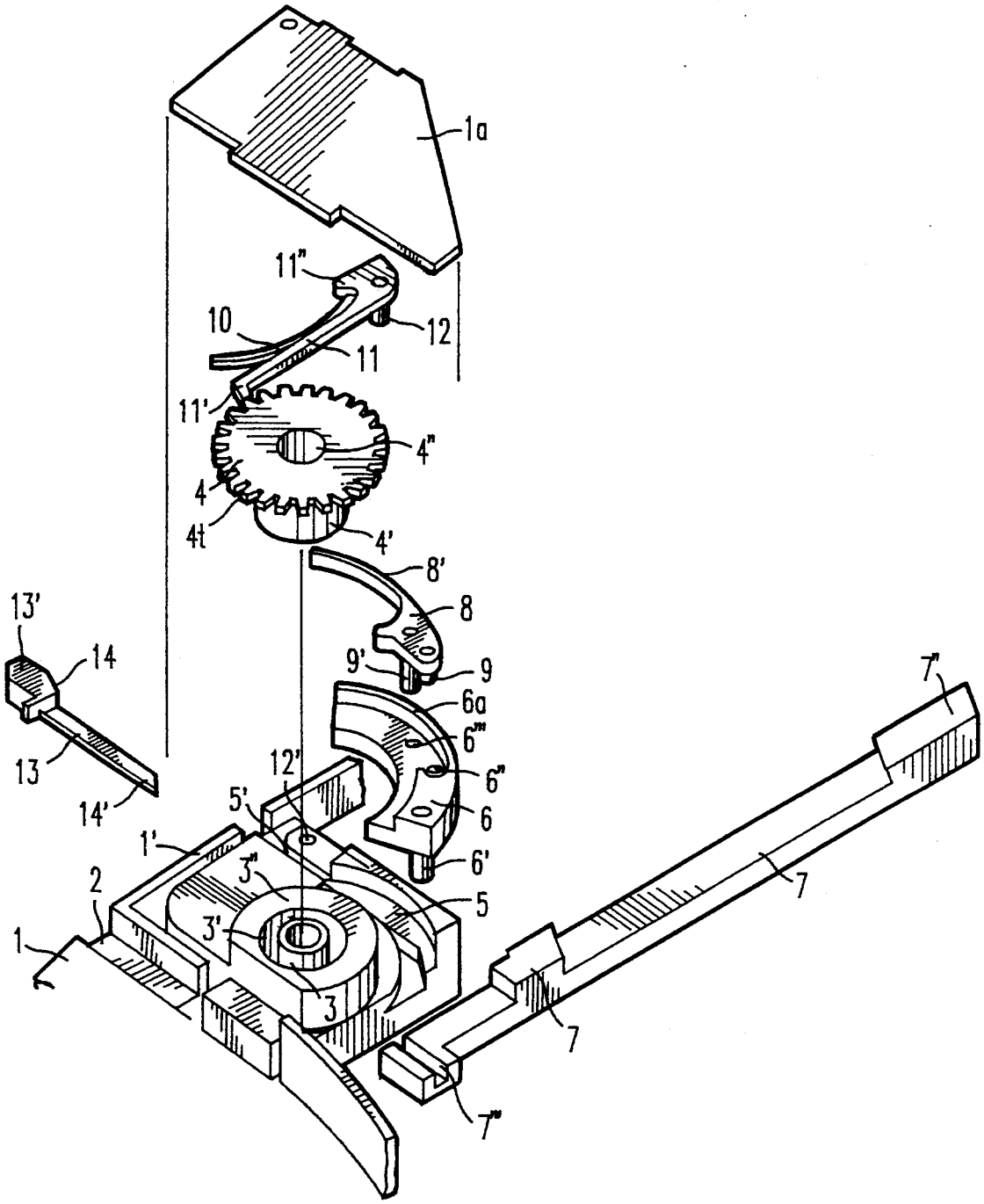
FIG. 2 is an exploded perspective view of an important portion of the device according to the present invention.

Referring to the Figures, on the leading end portion of a main body 1, there is formed a guide slot 2 for supplying fasteners F, while to a side of the guide slot 2, there are formed a supporting shaft 3, a hole 3' for inserting a gear boss 4', and a supporting plate 3''. The boss 4' of a fastener supply gear 4 is inserted into the insertion hole 3', and a shaft hole 4'' is fitted around the supporting shaft 3 so that the gear 4 can movably contact the supporting plate 3'. The fasteners are supplied to their correct positions by teeth **4*t* of the gear 4**.

To a side of the supporting plate 3'' there is formed an arcuate sliding recess 5 in which a movable piece 6 can slide. The arcuate recess 5 has a center collinear with the rotational axis of the gear 4. The arcuate movable piece 6 is placed within the sliding recess 5 in such a manner that the movable piece 6 is connected by a connecting pin 6' to a connecting slit 7''' of an actuation bar 7 which is provided with front and rear steps 7' and 7''. The straight lateral movements of the actuation bar 7 are thus converted to up and down arcuate movements of the movable piece 6 within the sliding recess 5.

A supporting pin 9 Of a ratchet 8 having an integral flat spring 8' is inserted into a pin hole 6'' of the movable piece 6, while a guide pin 9' of the ratchet 8 is inserted into an elongate guide hole 6''' of the movable piece 6. The flat spring 8' of the ratchet 8 is thus supported by a side wall **6*a* of the movable piece 6, and the pawl of the ratchet 8 abuts the teeth 4*t* of the supply gear 4 mounted on the supporting shaft 3**.

Above the gear 4 there is provided a stopper 11 with a flat spring 10 integrally formed thereon. A supporting pin 12 of the stopper is secured into a pin hole 12' of the main body 1. Owing to the biasing of the flat spring 10 which abuts to an upper side wall 1' of the main body 1, a hook 11' at the leading end of the stopper 11 is held between the teeth **4*t* of the gear 4** so that reverse revolution of the gear can be prevented.

An unlocking bar 13 is inserted into a slot 5' which intersects the sliding recess 5, and a cam surface 14 which is formed on a head 13' of the unlocking bar 13 contacts with a side step 11'' of the stopper 11. Another cam surface 14' which is formed on the lower end of the unlocking bar 13 contacts with the guide pin 9' which passes through the guide hole 6''' to move the guide pin within the hole. A cover 1*a* covers the gear 4, the movable piece 6 and the supporting pin 12.

A pulling lever 15 is pivotally mounted to the main body 1 and biased by a spring 15'. An actuation lever 16 pivoted to the main body is pivoted by the pulling lever 15 to advance a slider 17. A push rod 17' is held by the slider 17 so that advancement or retraction of the slider also advances or retracts the push rod. A hollow needle 18 is aligned with the push rod and fixed to the body 1.

The device of the present invention constituted as above will now be described as to its operations.

Fasteners F are first inserted into the supply guide slot 2 and are thereby engaged with the teeth 4*t* of the supply gear 4 so that new fasteners are fed by rotation of gear 4. The needle 18 of the main body 1 is passed through a tag (not shown) and through the article on which the tag is to be attached. In this state, if the pulling lever 15 is pulled, the actuation lever 16 moves the slider 17 to the left in FIG. 1 and, at the same time, the push rod 17' pushes the fastener F to the slot of the needle 18, thereby attaching the tag. At the same time, the leftward movement of the actuation lever 16 causes it to push the left step 7' of the actuation bar 7 just before actuation is completed, thereby also moving the actuation bar 7 to the left (FIG. 3).

Figure 3:
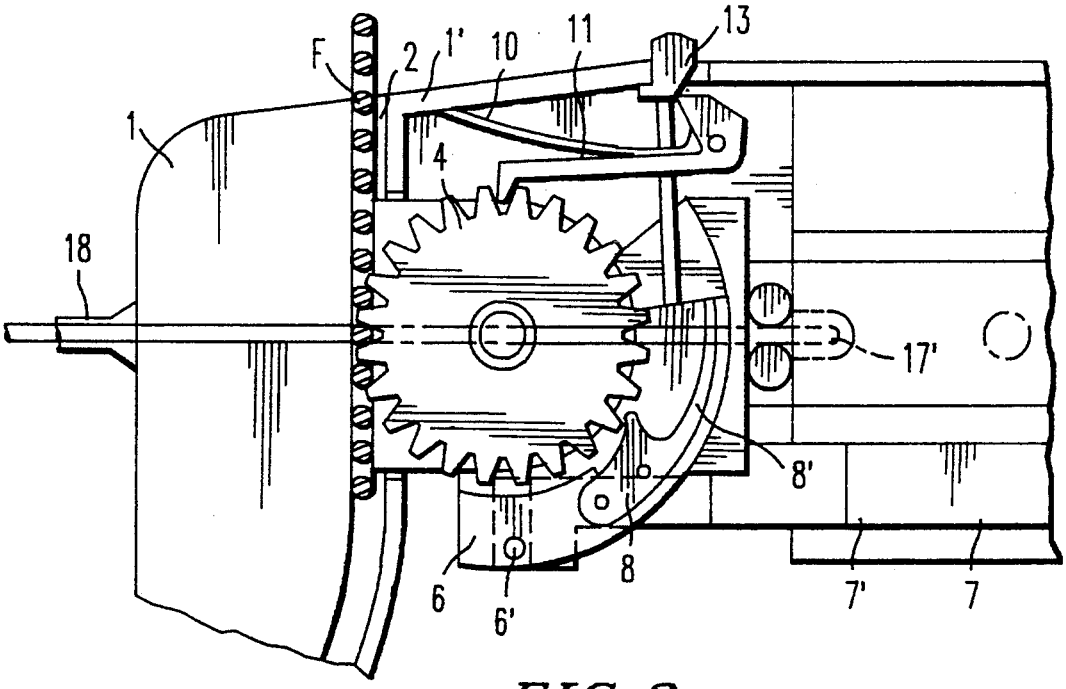
FIG. 3 is an exemplary sectional view showing the restoring motion of the movable piece according to the present invention.

When the actuation bar 7 has moved to the left as shown in FIG. 3, the movable piece 6 which is connected to the connecting slit 7''' by means of the connecting pin 6' moves within the sliding recess 5 to move the ratchet 8 downwardly relative to the supply gear 4.

During this time, the upper portion of the supply gear 4 is engaged with the hook 11' of the stopper 11, so that the supply gear 4 cannot reversely rotate but remains in the stopped state.

Figure 4:
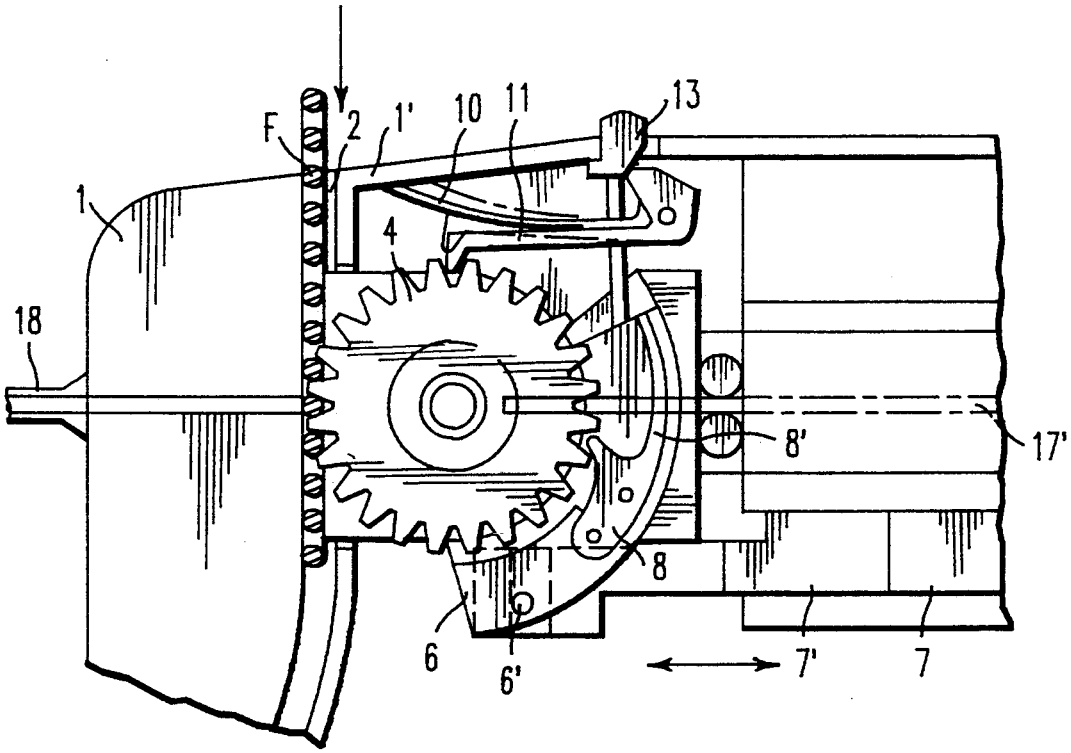
FIG. 4 is an exemplary sectional view showing the driving of the gear according to the present invention.

After the completion of the tag attaching operation, the pulling lever 15 is released and the pulling lever 15 is restored to its original position owing to the action of the spring 15'. Therefore, the actuation lever 16 which had moved to the left returns to the right side of FIG. 1. The position of the slider 17 of the push rod 17' is also restored, and so the push rod 17' departs from the needle 18. Immediately before the completion of the restoring action, the actuation lever 16 is engaged with the right step 7'' of the actuation bar 7, so that the actuation bar 7 also moves to the right by a small distance. In accordance with the movement of the actuation bar 7, the movable piece 6 which is at its lower position as shown in FIG. 4 moves arcuately upward within the sliding recess 5. Simultaneously with the movement of the movable piece 6, the ratchet 8 which is engaged between the teeth 4*t* of the gear 4 turns the supply gear 4 counter-clockwise by a distance corresponding to the movement of the movable piece 6. Accordingly a new one of the fasteners F in the supply guide slot 2 is supplied to the correct position at the rear of the needle 18 by the revolving gear 4, thereby preparing for the next attachment operation.

The tags can be attached through the repetition of the above operations. In synchronization with the tag attaching operations and, in coordination with the left and right movement of the actuation bar 7, the movable piece 6 performs up and down arcuate movements within the sliding recess 5 to intermittently drive the supply gear 4, thereby supplying the fasteners. In this state, during the rotation of the supply gear 4, the hook 11' of the stopper 11 is raised by the teeth of the supply gear 4 owing to the inclined angle of the hook 11', and therefore the gear 4 revolves smoothly while its reverse revolution is prevented.

Figure 5:
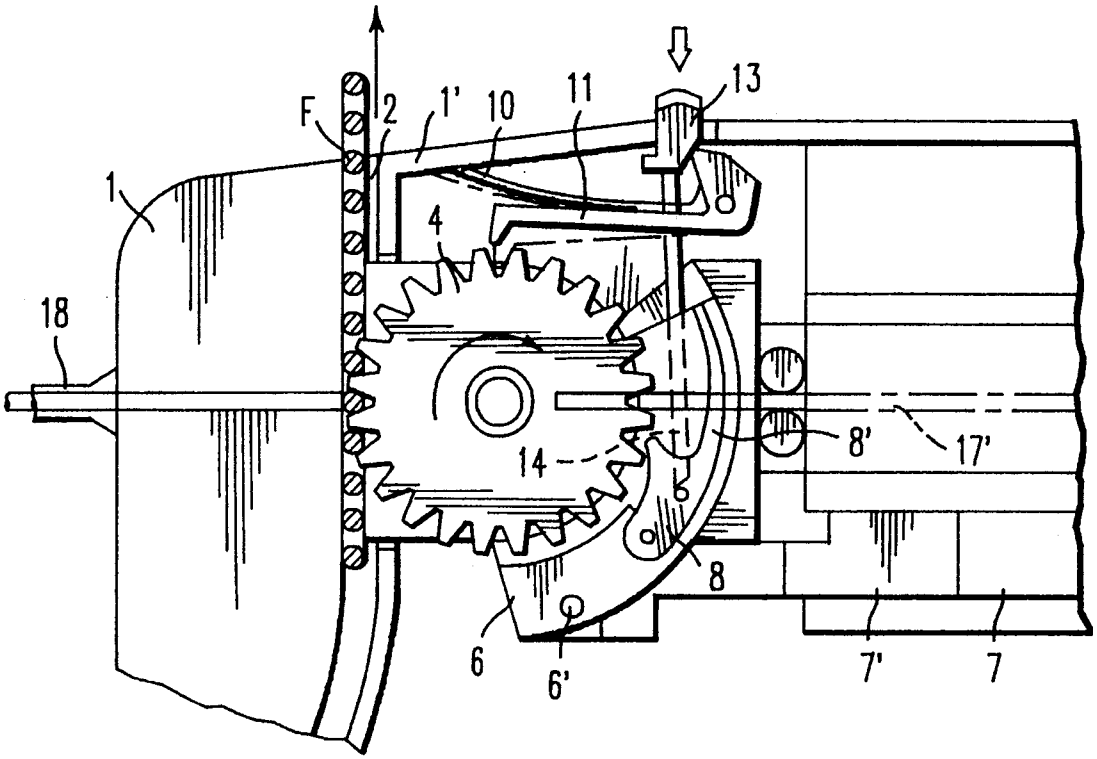
FIG. 5 is an exemplary sectional view showing the unlocking of the stopper and the ratchet by an unlocking bar according to the present invention.

Meanwhile, as shown in FIG. 5, if the fastener in use is pulled up from the main body, the upward movement is impossible because the supply gear 4 cannot be rotated reversely. In this case, if the head portion of the unlocking bar 13 is pressed down, the cam surface 14 of the head 13' contacts the side step 11'' of the stopper 11, with the result that the hook 11' of the stopper 11 is separated from the teeth 4*t* of the gear 4. Further, the cam surface 14' which is formed on the lower portion of the unlocking bar 13 contacts with the guide pin 9'' of the ratchet 8, which passes through the guide hole 6''' of the movable piece 6. Thus the cam surface 14' pushes spring 8' so that it separates from the teeth 4*t* of the gear 4. Consequently, the gear 4 is put in an idly rotatable state and, in this state, the fasteners F can be pulled up and extracted from the guide slot.

According to the present invention as described above, the fastener supply gear is securely installed on the main body by means of the supporting shaft, the boss insertion hole and the supporting plate, so that the gear is securely supported and can supply fasteners in an accurate manner. Further, the arcuate sliding recess formed at a side of the gear, and the movable piece sliding within the recess and connected to the ratchet and to an actuation bar, convert the straight lateral movements of the actuation bar into up and down arcuate movements of the movable piece. Consequently, the ratchet drives the supply gear in an accurate manner in supplying the fasteners. Even if the main body is dropped or receives other impacts, the ratchet does not depart from its operating position, because the movable piece 6 is securely placed within the sliding recess 5. Thus the ratchet maintains contact with the supply gear all the time, and so performs its function without fail.

Further, since the unlocking bar unlocks the stopper and the ratchet simultaneously, it has two functions. Further the structure of the device is simple, and the number of the parts is decreased, so that the fastener supplying mechanism can have a small space. Thus the device of the present invention assures perfect functioning and convenience compared with the conventional device.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A tag attacher comprising:

a body;

a supply gear rotatably supported in said body and engageable with fasteners loaded in said body for securely holding said fasteners;

a rotational device engaging said supply gear to apply one way rotational device drive to said supply gear for feeding fasteners into said body;

a stopper engaging said supply gear to prevent reverse rotation of said supply gear; and means for driving a fastener to attach a tag and actuating said rotational drive device;

wherein said rotational device comprises:

an arcuate recess in said body and having a center of curvature substantially collinear with a rotational axis of said supply gear;

an arcuate piece movably positioned in said recess; and a ratchet mounted to said arcuate piece and engageable with teeth of said supply gear.

2. The tag attacher of claim 1 wherein said means for driving comprises:

an actuation bar connected to said arcuate piece for moving said arcuate piece to cause said ratchet to drive said supply gear; and an actuation lever movable to simultaneously drive a fastener and move said actuation bar.

3. The tag attacher of claim 2 wherein said actuation bar is mounted in said body for linear movement and includes steps engagable by said actuation lever.

4. The tag attacher of claim 1 further including an unlocking device for selectively unlocking said supply gear for free rotational movement.

5. The tag attacher of claim 1 wherein said body includes a supporting plate upon which said supply gear is rotatably mounted.

6. The tag attacher of claim 2 further including an unlocking device for selectively unlocking said supply gear for free rotational movement.

7. The tag attacher of claim 6 wherein said unlocking device comprises a manually actuatable locking bar including:

a first cam surface engagable with said stopper for disengaging said stopper from said supply gear upon manual actuation of said locking bar; and a second cam surface engagable with said ratchet for disengaging said ratchet from said supply gear upon manual actuation of said locking bar.

8. The tag attacher of claim 1 wherein said ratchet includes a spring biasing said ratchet to engage with the teeth of said supply gear.

9. The tag attacher of claim 1 wherein said stopper includes a spring biasing said stopper to engage with the teeth of said supply gear.

* * * * *

UNITED STATES PATENT AND TRADEMARK OFFICE

CERTIFICATE OF CORRECTION

PATENT NO. : 5,398,859

DATED : March 21, 1995

INVENTOR(S) : Duck H. LEE

It is certified that error appears in the above-indentified patent and that said Letters Patent is hereby corrected as shown below:

On the title page, Item [30], the Foreign Application Priority Date is listed incorrectly. It should read:

--Nov. 5, 1992--

Signed and Sealed this

Thirteenth Day of June, 1995

*Attest:*

Bruce Lehman

BRUCE LEHMAN

*Attesting Officer*

*Commissioner of Patents and Trademarks*